US005429265A

United States Patent [19]

Maire et al.

[11] Patent Number: 5,429,265

[45] Date of Patent: Jul. 4, 1995

[54] COVER FOR BUCKET MOUNTED TOOL CARRIER

[75] Inventors: Paul R. Maire, Edina; Robert W. Fierek, Duluth, both of Minn.

[73] Assignee: Portable Products, Inc., St. Paul, Minn.

[21] Appl. No.: 368,231

[22] Filed: Jan. 3, 1995

Related U.S. Application Data

[63] Continuation of Ser. No. 129,863, Sep. 30, 1993, abandoned, which is a continuation of Ser. No. 896,687, Jun. 10, 1992, abandoned.

[51] Int. Cl.[6] ..... B65D 1/24

[52] U.S. Cl. ..... 220/522; 220/212; 220/379; 220/735; 220/751; 206/372; 206/373

[58] Field of Search ..... 220/522, 212, 521, 553, 220/379, 735, 736, 751; 297/193, 217; 206/372, 373

[56] References Cited

U.S. PATENT DOCUMENTS

| | | | |
|---|---|---|---|
| 2,732,119 | 1/1956 | Risch | 220/522 X |
| 2,919,169 | 12/1959 | Jackson | 297/193 |
| 3,145,646 | 8/1964 | Levy | 297/193 |
| 3,751,845 | 8/1973 | van Leeuwen | 297/193 X |
| 4,295,680 | 10/1981 | Grasso | 220/212 X |
| 4,353,182 | 10/1982 | Junkas et al. | 297/193 X |
| 4,765,472 | 8/1988 | Dent | 206/373 |
| 4,889,257 | 12/1989 | Steffes | 220/212 X |
| 4,993,551 | 2/1991 | Lindsay | 206/373 |

*Primary Examiner*—Stephen J. Castellano
*Assistant Examiner*—Stephen Cronin
*Attorney, Agent, or Firm*—Merchant, Gould Smith, Edell, Welter & Schmidt

[57] ABSTRACT

A cover for use with a bucket mounted tool carrier, the cover being useful as a seat and an object holder when used in conjunction with the bucket mounted tool carrier.

2 Claims, 2 Drawing Sheets

COVER FOR BUCKET MOUNTED TOOL CARRIER

This is a continuation of application Ser. No. 08/129,863, filed Sep. 30, 1993 which is a continuation of application Ser. No. 07/896,687, filed Jun. 10, 1992, both now abandoned.

FIELD OF THE INVENTION

Bucket mounted tool carriers are generally soft fabric-like materials which drapes over an empty bucket. The carriers generally comprise a plurality of pockets which are useful for the storage and carrying of tools and other smaller utensils.

BACKGROUND OF THE INVENTION

It is known to have a generally cylindrical article manufactured from a fabric-like material such as canvas and nylon, which, when draped over an empty pail or bucket (preferably five gallon) converts the bucket to a tool holding device. Such a tool holding device is generally referred to in the industry as a bucket mounted tool carrier. Bucket mounted tool carriers have a plurality of pockets surrounding the outside and inside of the bucket which are useful for tools, garden tools, or any other utensils which are preferably organized and kept together.

Bucket mounted tool carriers, commercially available from Portable Products, Inc. are disclosed in patent application Ser. No. 07/670,144. These tool carriers have a plurality of pleated pockets located on the outside of the tool carrier. Inner pockets are disclosed as well. The inner portion of the tool carrier is open, such that larger objects may be placed inside the bucket. Bucket mounted tool carriers are designed to fit over a five gallon pail, which is a commercially standard size bucket used to store many items in the construction industry. The bucket mounted tool carrier drapes around the point of attachment for the handle to the bucket such that the bucket may be carried easily from job site to job site. The bucket mounted tool carriers have gained popular acceptance in trades such as carpentry, construction, roofing, as well as with consumers.

Generally, the users of such bucket mounted tool carriers carry all their necessary tools to be used in their trade, and thus the tool carrier is always at hand.

As a result of the wide spread use of the bucket mounted tool carrier as well as the users of such tool carriers transporting the tool carriers with them wherever they go, the need exists for more versatile and multi-functional tool carrier which would further meet the needs of the users. To date, no satisfactory solutions to expand and improve the bucket mounted tool carriers have been shown.

SUMMARY OF THE INVENTION

A multi-functional cover for a bucket mounted tool carrier, the bucket having a rim, the cover having a first and second face, the first face being configured such that the face can be used as a means for a seat, the second face adopted such that the second face may be used as a means for holding objects, the cover having a flange portion extending substantially around the circumference, the flange having at least two stepped configurations, the first stepped configuration engaging the bucket rim such that the first face may be used as a means for a seat, the second stepped configuration engaging the bucket rim such that the second face may be used as a means for holding objects.

DETAILED DESCRIPTION OF THE INVENTION

Bucket mounted tool carriers are generally one piece, sewn tubular constructions which fit snugly over a bucket. The tool carriers are generally designed to fit over a bucket having handle attachments on each side of the bucket. When the tool carriers are positioned on a bucket, beginning from a lower edge of the outside of the bucket, there are a plurality of pockets generally encircling the bucket, except for a discontinuity which occurs generally beneath the portion of the bucket where the handle is attached to the bucket. There could be one or more rows of pockets on the outside or as many pockets as is necessary to fit the intended use. Preferably, the pockets are pleated such that expansion may occur when a large bulkier tool or article is placed in the pocket.

Moving upwardly towards the top lip of the bucket, the tool carrier drapes over the lip and lines the inside of the bucket. The inside of the tool carrier may or may not have pockets and may or may not have a bottom sewn therein. The inner part of the tool carrier may extend all the way down to the bottom of the bucket or may simply terminate anywhere between the lip and the bottom.

Preferably, the tool carrier is a tubular construction, but may be a split construction which may be connected by ties, snaps, hook fasteners or any other type of fastening device.

Regarding the present invention, the design of the tool carrier is immaterial, but rather just the presence of the tool carrier on a pail is all that is necessary. Thus, it is envisioned that any type of tool carrier, fitting any size bucket may be useful with the present invention.

Figure 1:
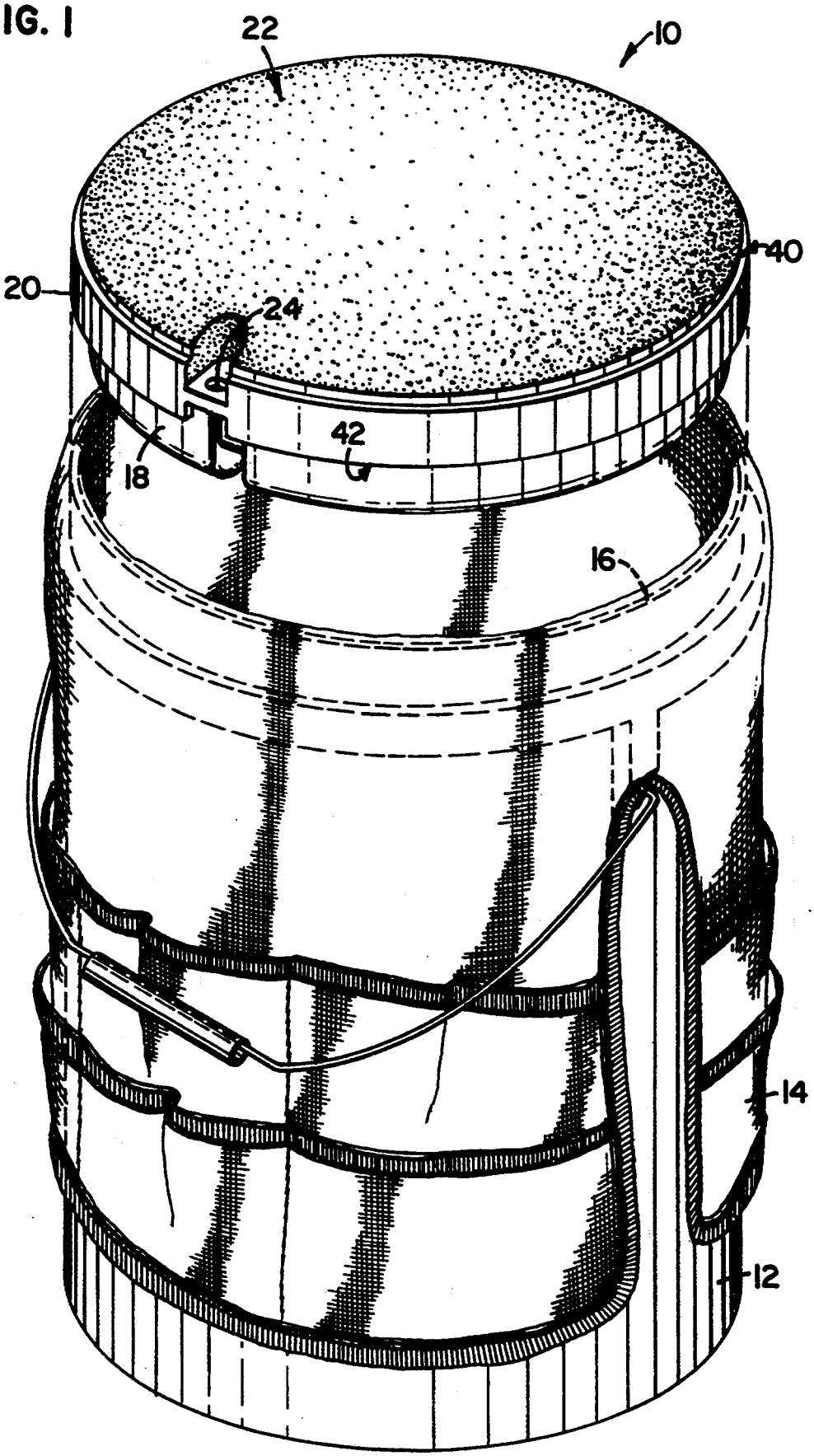
FIG. 1 is a perspective view of the cover of the present invention.

The cover of the present invention is generally disclosed in FIG. 1. The cover 10 is sized such that it fits snugly on bucket 12 with the tool carrier 14 positioned over bucket 12. Bucket 12 has rim 16 which defines the opening to bucket 12.

Cover 10 is configured such that as it is lowered into bucket 12, rim portion 18 is inserted in bucket 12. Cover 10, is engaged in bucket 12, by flange 20, which engages rim 16 such that cover 10 is securely fastened on bucket 12. First face 22 has generally an arcuate profile, such that it is comfortable when a user sits on face 22. Face 22 may have any design or form, such that it is comfortable for an individual to set on. Aperture 24 is optionally configured on cover 10, such that the cover 10 may be hung on a nail or other object when not in use.

Figure 2:
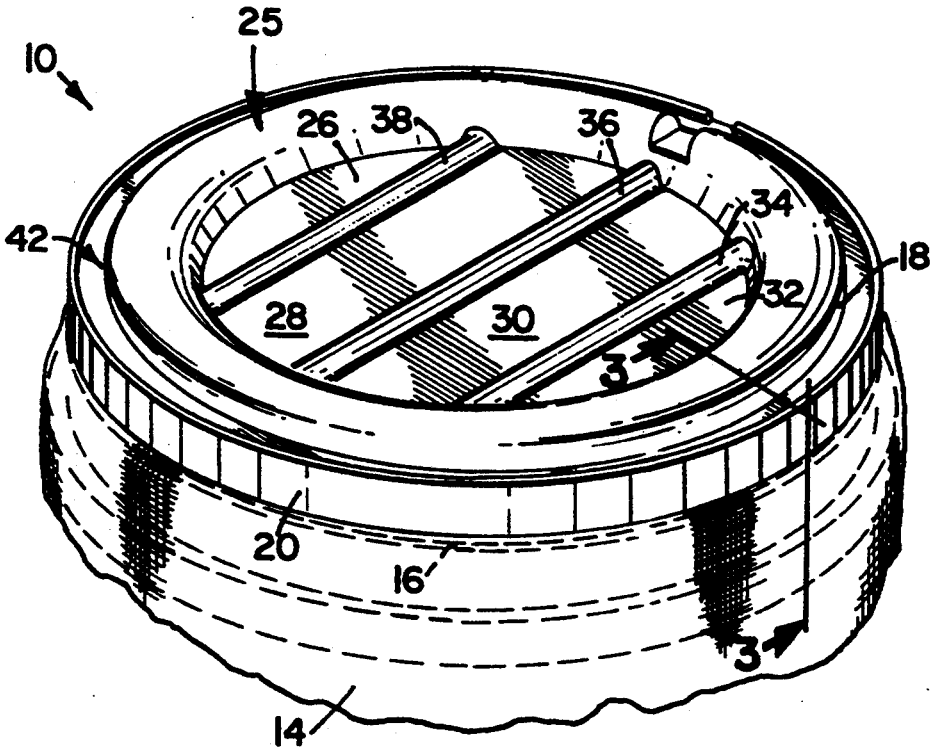
FIG. 2 is a perspective view of a face of the present invention.

Referring to FIG. 2, a second face 25 of the cover 10 of the present invention is shown. A plurality of compartments 25, 26, 30 and 32 are shown. Ribs 34, 36 and 38 are also shown. Ribs 34, 36 and 38 are useful as structural support to cover 10 when cover 10 is used as a seat. Compartments 24, 26, 28, 30 and 32 are useful to sort and store nails, screws, bolts or other types of objects which typically are used with the bucket mounted tool carrier. Thus, cover 10 serves a dual function purpose. It acts as a seat when face 22 is positioned upwardly, and acts as a means for storing objects when face 25 is faced upwardly. Depending upon the structure of cover 10, reinforcing ribs 34, 26 and 38 may or may not be necessary. Furthermore, any number of compartments, or a variety of sizes may be incorporated into face 24. It is also possible not to have any compartments, but merely have one open space for storing objects.

Figure 3:
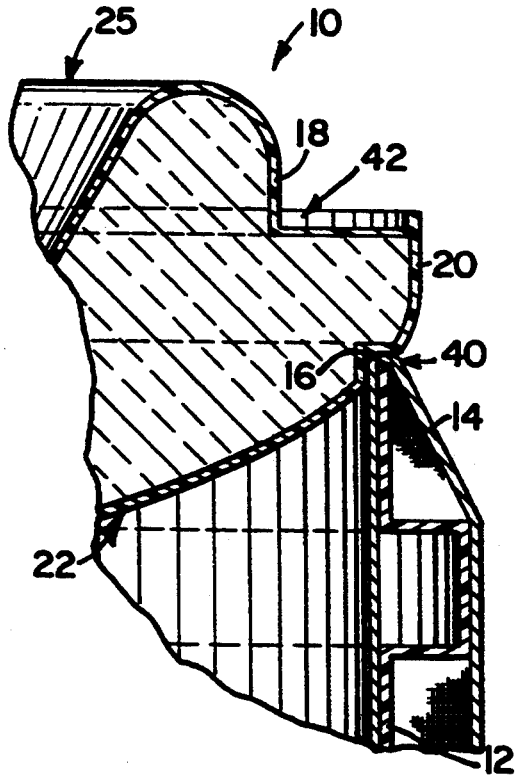
FIG. 3 is a cross-sectional view of the cover of the present invention.

Referring to FIG. 3, a cross section of cover 10 and bucket 12 is shown. Flange 20 extends outwardly from rim 16. Stepped configurations 40 and 42 allow cover 10 to engage rim 16. Cover 10 is shown with face 26 facing upwardly. Obviously, cover 10 could be transposed 180° such that stepped configuration 42 is secured on rim 16 such that face 22 faces upwardly.

The above discussion illustrates my current understanding of the invention. However, since many variations of the invention can be made without departing from the spirit and scope of the invention, the invention resides wholly in the claims hereinafter appended.

I claim:

1. A multi-functional cover in combination with a bucket and a bucket mounted tool carrier, said bucket having a rim, said tool carrier configured to drape over said bucket and having a plurality of pockets, said cover having a first and second face, said first face being configured with an arcuate profile such that said face can be used as a seat, said second face having ribs acting in combination as reinforcement means for said cover thereby preventing collapse of said cover when an individual sits thereon as well as partition means dividing said face into a plurality of compartments such that said second face may be used as a means for holding objects, said cover having a flange portion extending substantially around said circumference, said flange having at least two stepped configurations, said first stepped configuration facing opposite said first face and configured to securely engage said bucket rim such that said cover may be used as said seat and said second stepped configuration facing opposite said second face and configured to engage said bucket rim such that said cover may be used as said means for holding objects.

2. A multi-functional cover in combination with a bucket and a bucket mounted tool carrier, said bucket having a rim, said tool carrier configured to drape over said bucket and having a plurality of pockets, said cover having a circumference, said cover have a first and second face, said first face being configured with an arcuate profile forming a seat, said second face having ribs acting in combination as reinforcement means for said cover thereby preventing collapse of the cover when an individual sits thereon as well as partition means dividing said face into a plurality of compartments, said cover having a flange portion extending substantially around the circumference, said flange having at least one stepped configuration, one stepped configuration of said at least one stepped configuration facing opposite said first face and configured to securely engage said bucket rim such that said cover may be used as said seat, said flange having a aperture.

* * * * *

UNITED STATES PATENT AND TRADEMARK OFFICE
CERTIFICATE OF CORRECTION

PATENT NO. : 5,429,265

DATED : July 4, 1995

INVENTOR(S) : Paul R. Maire et al.

It is certified that error appears in the above-identified patent and that said Letters Patent is hereby corrected as shown below:

On column 2, line 59, please delete "set" and substitute therefore --sit--

On column 4, line 18 (claim 2), please delete "have" and substitute therefore --having--

On column 4, line 31 (claim 2), please delete "." after the word "aperture"

On column 4, line 31 (claim 2), please insert --extending therethrough and having a circumference sufficient for use as an engaging means for hanging said cover on a pointed object.-- after the word "aperture"

Signed and Sealed this

Twelfth Day of December, 1995

*Attest:*

Bruce Lehman

BRUCE LEHMAN

*Attesting Officer*

*Commissioner of Patents and Trademarks*